US008863755B2

(12) United States Patent
Zhuang et al.

(10) Patent No.: US 8,863,755 B2
(45) Date of Patent: Oct. 21, 2014

(54) CONTROLLED FLAVOR RELEASE TOBACCO POUCH PRODUCTS AND METHODS OF MAKING

(75) Inventors: Shuzhong Zhuang, Henrico, VA (US); Warren Winterson, Chester, VA (US); Chun-Liang Shen, Henrico, VA (US)

(73) Assignee: Philip Morris USA Inc., Richmond, VA (US)

( * ) Notice: Subject to any disclaimer, the term of this patent is extended or adjusted under 35 U.S.C. 154(b) by 462 days.

(21) Appl. No.: 12/394,643

(22) Filed: Feb. 27, 2009

(65) Prior Publication Data

US 2010/0218779 A1 Sep. 2, 2010

(51) Int. Cl.

| | |
|---|---|
| ***A24B 13/00*** | (2006.01) |
| ***A24B 15/28*** | (2006.01) |
| ***A24B 15/18*** | (2006.01) |
| ***A24B 15/30*** | (2006.01) |

(52) U.S. Cl.

CPC ..... *A24B 15/281* (2013.01); *A24B 15/183* (2013.01); *A24B 15/30* (2013.01); *A24B 13/00* (2013.01)

USPC ..... 131/352; 131/274

(58) Field of Classification Search

CPC ..... A24B 13/00

USPC ..... 131/274, 352

See application file for complete search history.

(56) References Cited

U.S. PATENT DOCUMENTS

| | | | |
|---|---|---|---|
| 307,537 | A | 11/1884 | Foulks |
| 1,234,279 | A | 7/1917 | Buchanan |
| 1,376,586 | A | 5/1921 | Schwartz |
| 1,992,152 | A | 2/1935 | Yeates |
| 2,313,696 | A | 3/1941 | Yates |
| 2,306,400 | A | 12/1942 | Menzel |
| 2,318,101 | A | 5/1943 | Rose |
| 2,330,361 | A | 9/1943 | Howard |
| 2,528,778 | A | 11/1950 | Piazze |
| 3,067,068 | A | 12/1962 | Finberg |
| 3,162,199 | A | 12/1964 | Moll, Jr. |
| 3,174,889 | A | 3/1965 | Anderson et al. |
| 3,188,265 | A | 6/1965 | Charbonneau et al. |
| 3,203,432 | A | 8/1965 | Green et al. |

(Continued)

FOREIGN PATENT DOCUMENTS

| | | |
|---|---|---|
| EP | 0212234 A2 | 7/1986 |
| EP | 0145499 | 4/1989 |

(Continued)

OTHER PUBLICATIONS

Brabender Technologies, "Ingredient Bulk Density Table", Published Nov. 20, 2008, http://www.sawyerhanson.com/uploads/Brabender%20Ingredient%20bulk%20density%20table.pdf.*

(Continued)

*Primary Examiner* — Matthew Daniels
*Assistant Examiner* — Cynthia Szewczyk
(74) *Attorney, Agent, or Firm* — Buchanan Ingersoll & Rooney PC

(57) ABSTRACT

An oral tobacco pouch product providing controlled flavor release and methods of making are provided. The oral tobacco product includes a web containing a filling material. The filling material includes tobacco material and at least one hydrocolloid in an amount sufficient to retard the release of at least one tobacco flavor component from the tobacco material during use.

28 Claims, 2 Drawing Sheets

(56) References Cited

U.S. PATENT DOCUMENTS 3,353,543 A 11/1967 Sproull et al.
3,369,551 A 2/1968 Carroll
3,415,286 A 12/1968 Arnold et al.
3,600,807 A 8/1971 Sipos
3,607,299 A 9/1971 Bolt
3,692,536 A 9/1972 Fant
3,757,798 A 9/1973 Lambert
3,846,569 A 11/1974 Kaplan
3,932,192 A 1/1976 Nakashio et al.
4,109,663 A 8/1978 Maeda et al.
4,218,286 A 8/1980 Jones et al.
4,240,016 A 12/1980 Inaba et al.
4,341,228 A 7/1982 Keritsis et al.
4,347,855 A 9/1982 Lanzillotti et al.
4,347,857 A 9/1982 Boden
4,355,995 A 10/1982 Berger
4,357,950 A 11/1982 Berger
4,386,106 A 5/1983 Merritt et al.
4,510,950 A 4/1985 Keritsis
4,545,392 A * 10/1985 Sensabaugh et al. ..... 131/352
4,565,702 A 1/1986 Morley et al.
4,607,479 A 8/1986 Linden
4,624,269 A 11/1986 Story et al.
4,660,577 A 4/1987 Sensabaugh et al.
4,674,519 A 6/1987 Keritsis et al.
4,696,315 A * 9/1987 Summers ..... 131/359
4,702,264 A 10/1987 Graves, Jr.
4,703,765 A 11/1987 Paules et al.
4,797,287 A 1/1989 Pich et al.
4,874,000 A * 10/1989 Tamol et al. ..... 131/375
4,880,018 A 11/1989 Graves, Jr. et al.
4,880,697 A 11/1989 Caldwell et al.
4,892,483 A 1/1990 Douglas, Jr.
4,893,639 A 1/1990 White
4,907,605 A 3/1990 Ray et al.
4,917,161 A 4/1990 Townend
4,924,887 A 5/1990 Raker et al.
4,966,171 A 10/1990 Serrano et al.
4,981,522 A 1/1991 Nichols et al.
5,007,440 A 4/1991 Robinson et al.
5,105,836 A 4/1992 Gentry et al.
5,127,208 A 7/1992 Custer et al.
5,148,821 A 9/1992 Best et al.
5,167,244 A 12/1992 Kjerstad
5,174,088 A 12/1992 Focke et al.
5,186,185 A 2/1993 Mashiko et al.
5,211,985 A 5/1993 Shirley, Jr. et al.
5,240,016 A 8/1993 Nichols et al.
5,263,999 A 11/1993 Baldwin et al.
5,346,734 A 9/1994 Wydick, Jr.
5,372,149 A 12/1994 Roth et al.
5,387,416 A 2/1995 White et al.
5,525,351 A 6/1996 Dam
5,549,906 A 8/1996 Santus
5,598,868 A 2/1997 Jakob et al.
5,601,716 A 2/1997 Heinrich et al.
5,724,998 A 3/1998 Gellatly et al.
5,725,886 A 3/1998 Erkoboni et al.
5,726,161 A 3/1998 Whistler
5,773,062 A 6/1998 Cirigliano et al.
5,806,408 A 9/1998 DeBacker et al.
5,829,453 A 11/1998 White et al.
5,845,648 A 12/1998 Martin
5,921,955 A 7/1999 Mazer et al.
5,927,052 A 7/1999 Nippes et al.
5,997,691 A 12/1999 Gautam et al.
6,021,624 A 2/2000 Richison et al.
6,026,820 A 2/2000 Baggett, Jr. et al.
6,135,120 A 10/2000 Löfman et al.
6,143,316 A 11/2000 Hayden et al.
6,146,655 A 11/2000 Ruben
6,162,516 A 12/2000 Derr
6,280,761 B1 8/2001 Santus
6,287,612 B1 9/2001 Mandava et al.
6,325,859 B1 12/2001 De Roos et al.
6,383,475 B1 5/2002 Meyers et al.
6,414,033 B1 7/2002 Sceusa
6,444,253 B1 9/2002 Conklin et al.
6,455,068 B1 9/2002 Licari
D489,606 S 5/2004 Lofman
6,840,248 B2 1/2005 Zielke
6,871,473 B1 3/2005 Dutt et al.
6,878,695 B2 4/2005 Woo et al.
6,880,018 B1 4/2005 Kajiki et al.
6,895,974 B2 5/2005 Peele
6,942,848 B2 9/2005 Nelson et al.
6,958,429 B2 10/2005 Bruhn et al.
6,982,093 B2 1/2006 Licari
6,984,376 B2 1/2006 Stephenson et al.
7,030,092 B1 4/2006 Levine
7,032,601 B2 4/2006 Atchley et al.
7,090,858 B2 8/2006 Jayaraman
7,186,701 B2 3/2007 Kubota et al.
D568,576 S 5/2008 Neidle et al.
D585,626 S 2/2009 Chappell, Sr. et al.
7,584,843 B2 9/2009 Kutsch et al.
2002/0012689 A1 1/2002 Stillman
2002/0166563 A1 11/2002 Jupe et al.
2002/0170567 A1 11/2002 Rizzotto et al.
2003/0070687 A1 4/2003 Atchley et al.
2003/0109492 A1 6/2003 Loftsson
2003/0224090 A1 12/2003 Pearce et al.
2004/0015756 A1 1/2004 Chiu et al.
2004/0018293 A1 1/2004 Popplewell et al.
2004/0037879 A1 2/2004 Adusumilli et al.
2004/0118421 A1 6/2004 Hodin et al.
2004/0123873 A1 7/2004 Calandro et al.
2004/0145261 A1 7/2004 Ganter et al.
2004/0191322 A1 9/2004 Hansson
2004/0191366 A1 9/2004 Mangos et al.
2004/0202698 A1 10/2004 Ramji et al.
2004/0234479 A1 11/2004 Schleifenbaum et al.
2004/0247649 A1 12/2004 Pearce et al.
2004/0247744 A1 12/2004 Pearce et al.
2004/0247746 A1 12/2004 Pearce et al.
2005/0000531 A1 1/2005 Shi
2005/0003048 A1 1/2005 Pearce et al.
2005/0034738 A1 2/2005 Whalen
2005/0061339 A1 3/2005 Hansson et al.
2005/0081264 A1 4/2005 Brugliera et al.
2005/0098187 A1 5/2005 Grierson et al.
2005/0100640 A1 5/2005 Pearce
2005/0172976 A1 8/2005 Newman et al.
2005/0178398 A1 8/2005 Breslin et al.
2005/0210615 A1 9/2005 Shastry et al.
2005/0241656 A1 11/2005 Kennison
2005/0244521 A1 11/2005 Strickland et al.
2005/0287249 A1 12/2005 Shukla et al.
2006/0039973 A1 2/2006 Aldritt et al.
2006/0073190 A1 4/2006 Carroll et al.
2006/0118589 A1 6/2006 Arnarp et al.
2006/0144412 A1 7/2006 Mishra et al.
2006/0174901 A1 8/2006 Karles et al.
2006/0191548 A1 8/2006 Strickland et al.
2006/0204598 A1 9/2006 Thompson
2006/0228431 A1 10/2006 Eben et al.
2006/0275344 A1 12/2006 Mody et al.
2007/0000505 A1 1/2007 Zhuang et al.
2007/0012328 A1 1/2007 Winterson et al.
2007/0048431 A1 3/2007 Budwig et al.
2007/0062549 A1 3/2007 Holton, Jr. et al.
2007/0077307 A1 4/2007 Rosenberg et al.
2007/0095356 A1 5/2007 Winterson et al.
2007/0107747 A1 5/2007 Hill et al.
2007/0122526 A1 5/2007 Sweeney et al.
2007/0186941 A1 8/2007 Holton, Jr. et al.
2007/0186942 A1 8/2007 Strickland et al.
2007/0186943 A1 8/2007 Strickland et al.
2007/0186944 A1 8/2007 Strickland et al.
2007/0190157 A1* 8/2007 Sanghvi et al. ..... 424/489
2007/0207239 A1 9/2007 Neidle et al.
2007/0261707 A1 11/2007 Winterson et al.
2007/0267033 A1 11/2007 Mishra et al.
2007/0298061 A1 12/2007 Boghani et al.

(56) References Cited

U.S. PATENT DOCUMENTS

| | | | | |
|---|---|---|---|---|
| 2008/0014303 | A1 | 1/2008 | Jacops et al. | |
| 2008/0029110 | A1 | 2/2008 | Dube et al. | |
| 2008/0029116 | A1 | 2/2008 | Robinson et al. | |
| 2008/0029117 | A1 | 2/2008 | Mua et al. | |
| 2008/0081071 | A1 | 4/2008 | Sanghvi et al. | |
| 2008/0166395 | A1 | 7/2008 | Roush | |
| 2008/0173317 | A1 | 7/2008 | Robinson et al. | |
| 2008/0196730 | A1 | 8/2008 | Engstrom et al. | |
| 2008/0202533 | A1 * | 8/2008 | Mishra et al. | 131/119 |
| 2008/0202536 | A1 | 8/2008 | Torrence et al. | |
| 2008/0302682 | A1 | 12/2008 | Engstrom et al. | |
| 2008/0308115 | A1 | 12/2008 | Zimmermann | |
| 2008/0317911 | A1 | 12/2008 | Schleef et al. | |
| 2009/0004329 | A1 | 1/2009 | Gedevanishvili et al. | |
| 2009/0022856 | A1 | 1/2009 | Cheng et al. | |
| 2009/0022917 | A1 * | 1/2009 | Gedevanishvili et al. | 428/35.2 |
| 2009/0025738 | A1 | 1/2009 | Mua et al. | |
| 2009/0025739 | A1 | 1/2009 | Brinkley et al. | |
| 2009/0025740 | A1 | 1/2009 | Chappell, Sr. et al. | |
| 2009/0025741 | A1 | 1/2009 | Crawford et al. | |
| 2009/0035414 | A1 * | 2/2009 | Cheng et al. | 426/5 |
| 2009/0126746 | A1 | 5/2009 | Strickland et al. | |
| 2009/0301505 | A1 * | 12/2009 | Liu et al. | 131/274 |
| 2010/0300464 | A1 | 12/2010 | Gee et al. | |
| 2010/0300465 | A1 | 12/2010 | Zimmermann | |

FOREIGN PATENT DOCUMENTS

| | | | |
|---|---|---|---|
| EP | 0352107 | A2 | 1/1990 |
| EP | 0483500 | A1 | 5/1992 |
| EP | 0 422 898 | | 9/1994 |
| EP | 0 599 425 | | 10/1997 |
| EP | 1010639 | A1 | 6/2000 |
| EP | 1118274 | A | 7/2001 |
| GB | 725764 | | 3/1955 |
| GB | 924052 | | 4/1963 |
| GB | 1139684 | | 1/1969 |
| GB | 1350740 | | 4/1974 |
| GB | 2074838 | A | 11/1981 |
| JP | 03-240665 | | 10/1991 |
| WO | WO 94/25356 | | 11/1994 |
| WO | WO 97/45336 | | 12/1997 |
| WO | WO 99/40799 | | 8/1999 |
| WO | WO 00/57713 | | 10/2000 |
| WO | WO 01/70591 | A1 | 9/2001 |
| WO | WO 02/080707 | A1 | 10/2002 |
| WO | WO 03/028492 | A1 | 4/2003 |
| WO | WO 03/030881 | | 4/2003 |
| WO | WO 03/053175 | A2 | 7/2003 |
| WO | WO 2004/009445 | A2 | 1/2004 |
| WO | WO 2004/052335 | A1 | 6/2004 |
| WO | WO 2004/056219 | A1 | 7/2004 |
| WO | WO 2004/058217 | A2 | 7/2004 |
| WO | WO 2004/064811 | A1 | 8/2004 |
| WO | WO 2004/066986 | A1 | 8/2004 |
| WO | WO 2004/095959 | A1 | 11/2004 |
| WO | WO 2005/027815 | | 3/2005 |
| WO | WO2005/046363 | A | 5/2005 |
| WO | WO 2005/077232 | | 8/2005 |
| WO | WO 2005/084446 | | 9/2005 |
| WO | WO 2006/004480 | A1 | 1/2006 |
| WO | WO 2006/039487 | A | 4/2006 |
| WO | WO 2006/065192 | A1 | 6/2006 |
| WO | WO2006/090290 | A | 8/2006 |
| WO | WO 2006/105173 | A2 | 10/2006 |
| WO | WO 2006/120570 | A2 | 11/2006 |
| WO | WO 2006/127772 | A | 11/2006 |
| WO | WO 2007/037962 | | 4/2007 |
| WO | WO 2007/057789 | A2 | 5/2007 |
| WO | WO 2007/057791 | A2 | 5/2007 |
| WO | WO 2007/082599 | A1 | 7/2007 |
| WO | WO 2007/104573 | | 9/2007 |
| WO | WO 2007104573 | A2 * | 9/2007 |
| WO | WO 2007/126361 | A1 | 11/2007 |
| WO | WO 2008/016520 | A2 | 2/2008 |
| WO | WO 2008/042331 | A2 | 4/2008 |
| WO | WO 2008/104891 | A2 | 9/2008 |
| WO | WO 2008/140372 | A1 | 11/2008 |

OTHER PUBLICATIONS

International Search Report and Written Opinion dated Sep. 12, 2008 for PCT/IB2008/001378.

International Search Report and Written Opinion mailed Jan. 30, 2009 for PCT/IB2008/002598.

Invitation to Pay Additional Fees and Partial International Search Report dated Oct. 6, 2006 for PCT/IB2006/001611.

International Search Report and Written Opinion dated Feb. 27, 2007 for PCT/IB2006/002680.

International Preliminary Report on Patentability dated Oct. 30, 2007 for PCT/IB2006/001611.

International Preliminary Report on Patentability mailed Dec. 31, 2008 for PCT/IB2006/002680.

Chris Vervaet et al., Extrusion-Spheronisation a Literature Review, International Journal of Pharmaceutics, 116 (1995), pp. 131-146.

John C. Leffingwell et al., Tobacco Flavoring for Smoking Products, R. J. Reynolds Tobacco Company, 1972, cover page and table of contents.

F. El Saleh et al., Influence of Cellulose Type on the Properties of Extruded Pellets, S.T.P. Pharma Sciences 10, (5), 2000, pp. 379-385.

Otilia May Yue Koo et al., The Influence of Microcrystalline Cellulose Grade on Shape and Shape Distributions of Pellets Produced by Extrusion-Spheronization, Chem. Pharm. Bull. 49 (11) 2001, pp. 1383-1387.

Petra M. Fecher et al., Properties of Microcrystalline Cellulose and Powder Cellulose After Extrusion/Spheronization as Studied by Fourier Transform Raman Spectroscopy and Environmental Scanning Electron Microscopy, AAPS PharmSci. 2003; 5 (4), Article 31, pp. 1-13.

International Preliminary Report on Patentability dated Aug. 28, 2007 for PCT/IB2006/001114.

International Search Report and Written Opinion mailed Jul. 25, 2006 for PCT/IB2006/001114.

International Search Report and Written Opinion mailed Feb. 25, 2009 for PCT/IB2008/002566.

International Search Report and Written Opinion dated Aug. 6, 2007 for PCT/IB2006/004077.

International Search Report and Written Opinion mailed Mar. 24, 2009 for PCT/IB2008/002764.

International Preliminary Report on Patentability issued Jan. 19, 2010 for PCT/IB2008/002764.

International Search Report and Written Opinion mailed Jul. 17, 2009 for PCT/IB2008/002714.

International Preliminary Report on Patentability issued Jan. 19, 2010 for PCT/IB2008/002714.

International Preliminary Report on Patentability issued Dec. 11, 2009 for PCT/IB2008/002598.

International Search Report and Written Opinion mailed Mar. 25, 2009 for PCT/IB2008/002682.

International Preliminary Report on Patentability issued Jan. 19, 2010 for PCT/IB2008/002682.

International Search Report and Written Opinion mailed Mar. 31, 2009 for PCT/IB2008/002681.

U.S. Appl. No. 12/789,125, filed May 27, 2010.

U.S. Appl. No. 12/748,205, filed Mar. 26, 2010.

International Search Resort and Written Opinion mailed Mar. 13, 2009 for PCT/IB2008/002694.

International Preliminary Report on Patentability issued Jan. 19, 2010 for PCT/IB2008/002694.

Satel, Sally M.D., "A Smokeless Alternative to Quitting," Apr. 6, 2004, The New York Times, Accessed Oct. 25, 2010; http://query.nytimes.com/gst/fullpage.html?res=9402EFD91E39F935A35757C0A9629C8B63.

* cited by examiner

CONTROLLED FLAVOR RELEASE TOBACCO POUCH PRODUCTS AND METHODS OF MAKING

SUMMARY

An oral tobacco pouch product including a web defining an enclosure and an inner filling material contained within the web is provided. The filling material includes tobacco material capable of releasing tobacco flavor components and at least one hydrocolloid interspersed with the tobacco material in an amount sufficient to at least partially slow and/or retard the release of at least one tobacco flavor component from the tobacco material during use.

Preferably, the density of the filling material is about 10 lb/ft$^3$ (pounds per cubic foot) to about 50 lb/ft$^3$, more preferably 15 lb/ft$^3$ to about 30 lb/ft$^3$. In an embodiment, the filling material can further include at least one additive selected from the group consisting of flavorants, sweeteners, and combinations thereof. Preferred flavorants include mint flavorants, such as peppermint, spearmint, wintergreen, combinations thereof and the like. In an embodiment, the tobacco material is pasteurized. Preferably, the flavorants are in the form of oils that can be applied to the web and/or the filling material. In a preferred embodiment, the filling material includes smokeless tobacco and a supplemental amount of non-tobacco botanical material. The non-tobacco botanical material is selected from the group consisting of vegetable fibers, tea, herbs, spices, coffee, fruits and combinations thereof. Preferably, the filling material has a moisture content of about 5% to about 50% by weight based on the weight of the filling material. More preferably, the filling material has a moisture content of about 12% to about 25% by weight based on the weight of the filling material.

Preferably, the at least one hydrocolloid is selected from the group consisting of high-methylated pectin, low-methylated pectin, amidated pectin, hydroxyl methyl propyl cellulose, methyl cellulose, hydroxyl propyl cellulose, xanthan gum, agar, carrageenan, guar gum, alginate, carboxyl methyl cellulose, microcrystalline cellulose, starch, dextrin, maltodextrin. Most preferably, the at least one hydrocolloid is selected from the group consisting of pectin, carrageenan and combinations thereof. Also preferably, the at least one hydrocolloid comprises particles of about 300 mesh to about 10 mesh, more preferably about 200 mesh to about 20 mesh. In a preferred embodiment, the at least one hydrocolloid is included in the oral tobacco pouch product in an amount of about 0.1% to about 10% by weight based on the weight of the filling material or in an amount of about 1% to about 5% by weight based on the weight of the filling material.

In an embodiment, the web includes an outer web. In an alternative embodiment, the web includes and inner web and an outer web. Preferably, the web has a longitudinal seam and two transverse seams when formed into a pouch wrapper. In an embodiment, the web further comprises at least one coating. The coating is a polymeric coating and wherein the coating is present in an amount of about 1 g/m$^2$ (grams per square meter) to about 50 g/m$^2$ on web. Preferably, the coating has a moisture content of about 5% to about 8% by weight based on the weight of the coating. The coating may include at least one additive selected from the group consisting of flavorants, sweeteners, and combinations thereof. Preferably, the web comprises unflavored paper.

A method of making an oral tobacco pouch product is also provided. the method includes feeding a web along a feed path, folding the web into a tubular formation, forming a longitudinal seam along overlapping edges of the web and a lower transverse seam across the tubular formation, placing a portion of a filling material comprising tobacco material and at least one hydrocolloid into the tubular formation above the transverse seam, and forming an upper transverse seam across the tubular formation to enclose the filling material. The at least one hydrocolloid is included in an amount sufficient to at least partially slow the release of tobacco juices from the tobacco material. In an embodiment, the method also includes mixing the tobacco material and the at least one hydrocolloid to form a substantially uniform filling material.

DETAILED DESCRIPTION

Figure 1:
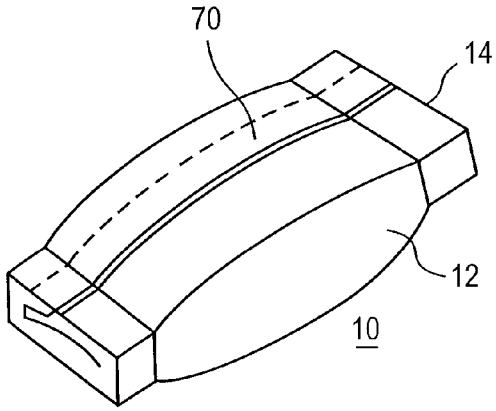
FIG. 1 is a perspective view of an oral tobacco pouch product providing controlled flavor release.

As used herein, the term "oral tobacco pouch product" generally denotes a pouch product which fits in a user's mouth and delivers a desirable taste, aroma, or combination of two or more of these for tobacco enjoyment when placed through contact with the consumer's taste buds, olfactory receptors, or both, preferably via the consumer's saliva. The oral tobacco pouch product contains a filling material comprising tobacco material and at least one hydrocolloid.

An oral tobacco pouch product providing controlled flavor release and methods of making oral tobacco pouch products are provided. Controlled flavor release of the oral tobacco pouch product is accomplished by adding at least one hydrocolloid to the filling material of the oral tobacco pouch product to modify the physical properties of the filling material. If desired, the filling material can also include flavorants and/or other additives. Preferably, the modification of the properties of the filling material is achieved by mixing the at least one hydrocolloid with the tobacco filler. The hydrocolloids can provide a range of water holding capacity depending on the hydrocolloid added and/or the amount of the hydrocolloid added. In addition, based on the physical and chemical characteristics of the hydrocolloids, the selected hydrocolloids can act a binding agent, a viscosity modifier, a thickener, a coating agent, or a film former. Thus, the final filling material can have a range of characteristics including water holding capacities, adhesive properties, and packing densities. Such characteristics can impact the sensorial experience such as flavor immediacy, flavor release duration, moistness, salivation and burning sensation of the oral tobacco pouch product when placed in a user's mouth. If desired, the filling material can be compacted during the pouch making process. In other embodiments, the filling material can be compressed and/or extruded into a pre-formed structure with higher packing density prior to placement in the pouch wrapper to further alter the rate of flavor release. In further embodiments, the filling material is incorporated as a loose filling material within the oral tobacco pouch product.

Not wishing to be bound by theory, it is believed that the presence of the at least one hydrocolloid in the oral tobacco pouch products interferes with the extraction of undesirable objectionable flavor compounds from the tobacco by saliva when placed in the mouth. This interference is thought to be accomplished by three complementary mechanisms including: (1) thickening of saliva by the hydrocolloid, which reduces the rate of saliva flow and consequently the mass transfer from the tobacco to saliva, (2) spatial interference as the hydrocolloid swells and blocks access to extraction sites for saliva contact, and (3) competitive absorption of saliva and extracted tobacco flavor compounds by the hydrocolloid, which slows the release of the tobacco flavor compounds to taste receptors in the mouth.

As described herein and illustrated in FIG. 1, an oral tobacco pouch product 10 comprises a pouch wrapper formed by a web 12 and a filling material (shown in FIGS. 2 and 3) contained within the web 12. The oral tobacco pouch product 10 is designed to be placed in the mouth, preferably between the cheek and gum, for oral enjoyment.

Figure 2:
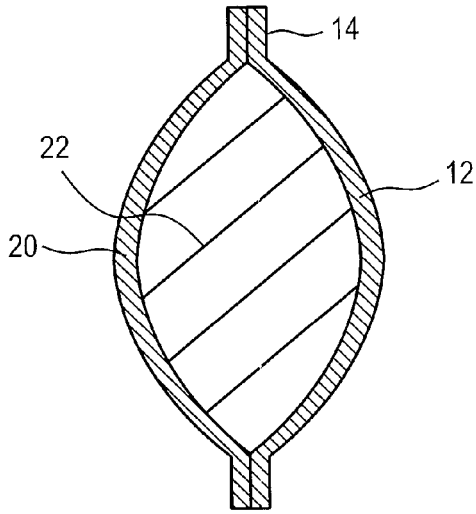
FIG. 2 is a longitudinal cross-sectional view of a first embodiment of an oral tobacco pouch product providing controlled flavor release.

As shown in FIGS. 1 and 2, the web 12 comprises an outer web 20 that is formed of a permeable or semi-permeable material, such that saliva can pass through the outer web 20 to the interior of the pouch product 10, and the flavors and juices from the filling material contained within the interior of the pouch product 10 can be drawn out of the pouch and into the user's mouth.

In a preferred embodiment, outer web 20 comprises paper suitable for oral pouch products commonly referred to as "snus" or snuff. For example, the web can be formed of a cellulose fiber material, such as tea bag material or materials typically used to form snus pouches. Desirably, the outer web 20 of the porous pouch wrapper 12 is made from a material suitable for contact with food, such as materials used in packaging or handling foods. Preferred porous materials include, but are not limited to, films, gelatin, food casings, carrageenan, biopolymers, fabric (woven or non-woven), and/or paper such as filter paper, papers used to construct tea bags, coffee filters, and the like. Preferably, the material used to form the web 20 has a neutral or pleasant taste or aroma. Preferably, the material used to form the web 20 is selected to have desired properties of stain resistance, water permeability and/or porosity, and/or water insolubility.

Additionally, the materials used to form the outer web 20 can be provided with predetermined levels for basis weight and/or wet strength in order to reduce occurrence of breakage of the pouch wrapper 12 during manufacturing operations, storage and use. For example, an outer web 20 can be provided with a basis weight of about 5 to about 25 g/m$^2$, such as 5-10, 10-15, 15-20, or 20-25 grams/meters$^2$ (g/m$^2$) depending upon the final usage requirements, and/or a wet tensile cross-direction (CD) strength of about 15 to about 75 N/m, such as 15-30, 30-45, 45-60, or 60-75 Newtons/meter (N/m) depending upon the final usage requirements. One exemplary material is a tea bag material with a basis weight of about 16.5 g/m$^2$ with a wet tensile CD strength of 68 N/m.

It is also noted that the thickness of the outer web 20 can be varied to achieve desired levels of solubility through the pouch wrapper 12. For example. the paper can be about 0.1 mm to about 0.125 mm thick or about 0.07 mm to about 0.08 mm thick.

In a preferred embodiment, the web 12 maintains sufficient structural integrity during the time period that the web 12 is used so that the filling material 22 is retained therein. In an embodiment, flavorants may be added to the web 12 to provide additional flavor to the user. For example, peppermint oil can be applied to the web 12 to deliver flavor during use.

Figure 3:
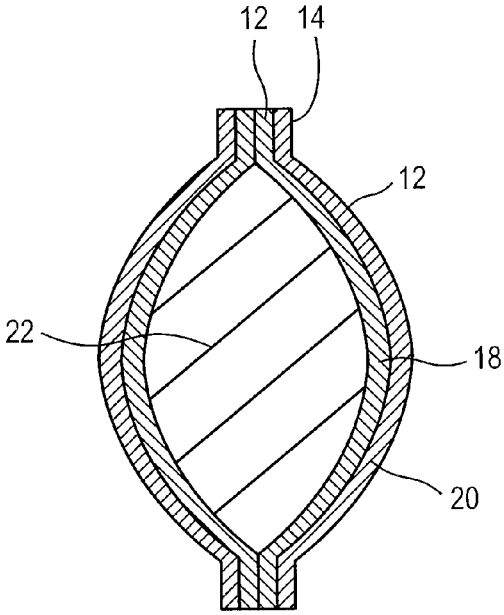
FIG. 3 is a longitudinal cross-sectional view of a second embodiment of an oral tobacco pouch product providing controlled flavor release.
Figure 4:
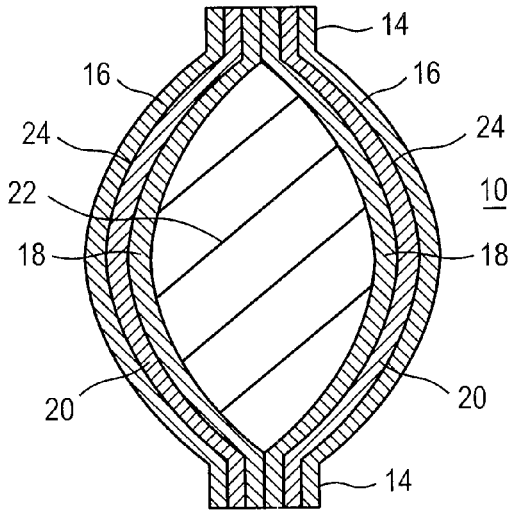
FIG. 4 is a longitudinal cross-sectional view of a third embodiment of an oral tobacco pouch product providing controlled flavor release.

Preferably, as shown in FIGS. 2, 3 and 4, the filling material 22 comprises tobacco material and at least one hydrocolloid. Preferably, the filling material has a moisture content of about 5% to about 50%. More preferably, the filling material has a moisture content of about 12% to about 25%. Even more preferably, the filling material has a moisture content of about 15% to about 20%.

Exemplary tobacco materials can be made of cut or ground tobacco and can include flavorants, additives and/or humectants. Examples of suitable types of tobacco materials that may be used include, but are not limited to, flue-cured tobacco, Burley tobacco, Maryland tobacco, Oriental tobacco, rare tobacco, specialty tobacco, reconstituted tobacco, blends thereof and the like. In a preferred embodiment, the tobacco material is pasteurized. In the alternative, the tobacco may be fermented.

The tobacco material may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, tobacco beads, blends thereof, and the like. Genetically modified tobacco and other treated tobaccos may also be used in the filling material 22. Also preferably, the tobacco material is smaller than about 20 mesh for ease of pouching.

In a preferred embodiment, the filling material 22 can also include a supplemental amount of botanical material other than tobacco. Suitable non-tobacco botanical materials include, without limitation, sugar beet fiber (Fibrex®), other vegetable fibers, teas, herbs, spices, coffee, fruits and combinations thereof. Preferably, the non-tobacco botanical material is included in an amount of about 5% to about 45% by weight based on the weight of the filling material. Even more preferably, the non-tobacco botanical material is included in an amount of about 10% to about 40% by weight based on the weight of the filling material. These ranges for inclusion of the non-tobacco botanical material may be even further configured as follows: (a) about 20% to about 40% or (b) about 25% to about 35%.

In the preferred embodiment, the filling material 22 also includes at least one hydrocolloid which is in contact with and/or mixed with the tobacco material. Preferably, the hydrocolloid is mixed or incorporated with the tobacco material to form a uniform mixture. Suitable hydrocolloids are selected from the group consisting of high-methlylated pectin, low-methlylated pectin, amidated pectin, hydroxyl methyl propyl cellulose, methyl cellulose, hydroxyl propyl cellulose, xanthan gum, agar, carrageenan, guar gum, alginate, carboxyl methyl cellulose, microcrystalline cellulose, starch, dextrin, maltodextrin, and combinations thereof. In a preferred embodiment, the hydrocolloid is selected from the group consisting of pectin, carrageenan (or other natural gum) and combinations therewith.

Preferably, the at least one hydrocolloid is included in an amount of about 0.1% to about 10% by weight based on the weight of the filling material, more preferably about 1% to about 5% by weight based on the weight of the filling material, and most preferably about 2% to about 4% by weight based on the weight of the filling material. The amount of the hydrocolloid added to the filling material can vary depending on the hydrocolloid(s) chosen. For example, pectin is preferably added in an amount of about 2% to about 3% by weight based on the weight of the filling material. Adding too much of the hydrocolloid can act to prevent flavor release from the oral tobacco pouch product during use, while adding too little of the hydrocolloid can result in ineffective slowing of the flavor release. Preferably, the hydrocolloid is uniformly distributed throughout the filling material so as to provide uniform flavor delivery during use.

Not wishing to be bound by theory, it is believed that the hydrocolloid absorbs the juices from the tobacco material and slowly releases the tobacco juices during use of the oral tobacco product. Thus, it is believed that the hydrocolloid increases water holding capacity of the filling material, and does not act as just a diluent. Thus, unexpectedly, the hydrocolloid slows down the perception of the tobacco flavors when the oral tobacco pouch product is in use. Thus, the presence of the hydrocolloids tones down, reduces, and/or retards the bitter flavor components (and thus the perceived bitterness) of the tobacco material.

Accordingly, in a preferred embodiment, the hydrocolloid acts to slowly release tobacco juices (and flavor components) from the oral tobacco pouch product 10 over a period of time. Preferably, the tobacco juices are released in about 1 minute to about 3 hours, more preferably the tobacco juices are released in about 5 minutes to about 2 hours, and even more preferably the tobacco juices are released in about 10 minutes to about 1 hour. These ranges for release time may be even further restricted as the most preferred ranges to be (a) about 15 minutes to about 60 minutes), (b) about 20 minutes to about 50 minutes, (c) about 25 minutes to about 45 minutes, or (d) about 30 minutes to about 40 minutes.

For example, in one embodiment, the oral tobacco pouch product 10 can comprise a web containing pasteurized tobacco material, about 2% pectin, peppermint oil, and sugar beet fiber. In other embodiments, the oral tobacco pouch product 10 can comprise a web containing tobacco material, about 2% to about 5% carrageenan and peppermint oil. The pectin and/or carrageenan acts to slow the release of the tobacco juices from the oral tobacco pouch product. In addition, the peppermint oil, applied to the filling material and/or the web can act to tone down the flavor of the tobacco juice and/or reduce bitterness of the tobacco flavor.

In another embodiment, additives can also be added to the filling material 22 and/or web 12 of the oral tobacco pouch product 10. Suitable additives include, without limitation, humectants, flavorants, sweeteners, acidity regulators and/or combinations thereof.

Humectants can also be added to the tobacco material, coating 16 (shown in FIG. 4), inner web 18 (shown in FIG. 3) and/or outer web 20 to help maintain the moisture levels in the oral tobacco pouch product 10. Examples of humectants that can be used include, without limitation, glycerol and propylene glycol. It is noted that the humectants can also be provided for a preservative effect, as the water activity of the oral tobacco pouch product 10 can be decreased with inclusion of a humectant, thus reducing opportunity for growth of microorganisms. Additionally, humectants can be used to provide a higher moisture feel to a drier tobacco component.

Suitable flavorants include any flavorants commonly used in foods, confections, smokeless tobacco products, tobacco articles, and/or other oral products. Exemplary flavorants include, but are not limited to, berry flavors such as pomegranate, acai, raspberry, blueberry, strawberry, boysenberry, and/or cranberry. Other suitable flavorants include, without limitation, any natural or synthetic flavor or aroma, such as menthol, peppermint, spearmint, wintergreen, bourbon, scotch, whiskey, cognac, hydrangea, lavender, chocolate, licorice, citrus and fruit flavors, such as apple, peach, pear, cherry, plum, orange, lime, grape, and grapefruit, gamma octalactone, vanillin, ethyl vanillin, breath freshener flavors, butter, rum, coconut, almond, pecan, walnut, hazelnut, French vanilla, macadamia, sugar cane, maple, cassis, caramel, banana, malt, espresso, kahlua, white chocolate, spice flavors such as cinnamon, clove, cilantro, basil, oregano, garlic, mustard, nutmeg, rosemary, thyme, tarragon, dill, sage, anise, and fennel, methyl salicylate, linalool, jasmine, coffee, olive oil, sesame oil, sunflower oil, bergamot oil, geranium oil, peanut oil, lemon oil, ginger oil, balsamic vinegar, rice wine vinegar and red wine vinegar. Particularly preferred flavorants include mint oils such as peppermint oil, spearmint oil, wintergreen oil and combinations thereof. Preferably, the mint oils are added to the web 12 and/or the filling material 22. Preferably, the flavorants are added to the oral tobacco pouch product 10 in an amount of about 0.1% to about 10% by weight based on the weight of the oral tobacco pouch product. More preferably, the flavorants are added to the oral tobacco pouch product 10 in an amount of about 1% to about 5% by weight based on the weight of the oral tobacco pouch product. The amount of flavorant added can depend on the flavorant used as some flavorants are more potent than others and therefore can provide adequate flavoring in smaller amounts.

Preferably, the flavorants can be applied to the filling material 22 and/or web 12 by spraying, coating, immersing, embossing, and/or dispersing the flavorants into or onto the filling material 22 and/or web 12. In an embodiment, the flavorants are added in the form of spray dried flavorants, essential oils, encapsulated flavorants, coacervated flavorants, colloidal encapsulated flavorants, suspensions, and/or solutions.

When the flavorants are encapsulated, the flavorants can also be provided by controlled release mechanisms such as pH change, heat activation, or mechanical activation through manipulating or sucking. In addition, flavorant capsules can have encapsulating coatings of various thicknesses so that the flavorants are released at varying rates to provide continuous or different flavor throughout use of the oral tobacco pouch product 10.

In an embodiment, suitable sweeteners include, without limitation, monosaccharides, disaccharides, and polysaccharides, xylose, ribose, sucrose, maltose, mannitol, sorbitol, xylitol, fructose, glucose, mannose, sucralose, and combinations thereof. The amount of sweetener added to the oral tobacco pouch product 10 can vary based on the sweetener and/or combination of sweeteners used. For example, sucralose may be added to the oral tobacco pouch product in an amount of about 0.1% to about 3% by weight based on the weight of the oral tobacco pouch product. More preferably, sucralose may be added to the oral tobacco pouch product in an amount of about 0.5% to about 1.5% by weight based on the weight of the oral tobacco pouch product. Also for example, sugar can be added in an amount of about 5% to about 25% by weight based on the weight of the oral tobacco pouch product. More preferably, sugar is added in an amount of about 10% to about 20% by weight based on the weight of the oral tobacco pouch product.

Suitable acidity regulators for inclusion in the oral tobacco pouch product 10 include, without limitation, sodium carbonate, potassium carbonate, calcium carbonate and combinations thereof. Preferably, the acidity regulator is added in an amount sufficient to form an oral tobacco pouch product 10 having a pH ranging from about 6 to about 8.5. More preferably, the acidity regulator is added in an amount sufficient to form an oral tobacco pouch product 10 having a pH ranging from about 7 to about 8.

In a preferred embodiment, the oral tobacco pouch product 10 is sized and configured to fit comfortably in a user's mouth, preferably between the cheek and gum. A user can suck, chew, or otherwise orally manipulate the oral tobacco pouch product 10 to release the flavors contained therein.

Preferably, the oral tobacco pouch product 10 weighs about 0.1 g to about 5.0 g. These ranges for weight can be further restricted to (a) about 0.1 g to about 1.0 g, (b) about 1.0 g to about 2.0 g, (c) about 2.0 g to about 3.0 g, (d) about 3.0 g to about 4.0 g or (e) about 4.0 g to about 5.0 g. Also preferably, the oral tobacco pouch product 10 is about 0.25 inch to about 2.0 inches in width, about 0.25 inch to about 2.0 inches in length, and about 0.05 inch to about 2.0 inches thick. In an embodiment, the oral tobacco pouch product 10 is about 0.1 inch to about 2.0 inches in width, about 0.1 inch to about 2.0 inches in length and about 0.05 inch to about 1.0 inch thick.

The oral tobacco pouch product 10 may have a square, rectangular, quadrilateral, circular, moon, crescent, or oblong shape. The oral tobacco pouch product 10 can also be shaped like a half-moon or D-shape, or can take other shapes, including, without limitation oval, pouch-shape, rod-shape, cylindrical, tea leaf, tear drop, or hourglass shapes. In some embodiments, the pouch-shape can be similar to a ravioli or pillow shape. Other shapes may be utilized so long as the shapes fit comfortably and discreetly in a user's mouth.

Preferably, sharp corners are avoided as sharp corners may lead to oral discomfort. In a preferred embodiment, the web 12 is sealed around one or more edges to contain the filling material 22 within the web 12.

The oral tobacco pouch product 10 can preferably deliver a plurality of flavorants to the user for a period of about 1 minute to about 3 hours. These ranges for flavor delivery can be further restricted to (a) about 5 minutes to about 75 minutes, (b) about 10 minutes to about 70 minutes, (c) about 15 minutes to about 65 minutes, (d) about 20 minutes to about 60 minutes, (e) about 25 minutes to about 55 minutes or (f) about 30 minutes to about 50 minutes. Preferably, the at least one hydrocolloid slows the release of tobacco flavors and juices from the oral tobacco pouch product 10 during use. Preferably, the oral tobacco pouch product 10 is discarded after a single use.

As shown in FIG. 1, in one embodiment, the oral tobacco pouch product 10 comprises a longitudinal seam 70. The longitudinal seam 70 can comprise overlapping sections of the outer web 20. Preferably, the oral tobacco pouch product 10 also includes at least one transverse seam 14. The transverse seams 14 can be formed such that the inner surface of the outer web 20 of the pouch wrapper 12 another section of the inner surface of the outer web 20 to form the transverse seam 14 (shown in FIG. 2).

As shown in FIG. 3, the web 12 may comprise an inner web 18 and an outer web 20. In the preferred embodiment, the inner web 18 can be made of the same materials as the outer web 20. In other embodiments, the inner web 18 can be made of a different material than the outer web 20. In another preferred embodiment, the inner web 18 reduces the tendency of the filling material 22 to discolor (stain) the outer web 20. The inner web 18 reduces staining of the outer web 20 by reducing the opportunity for moisture from the filling material 22 or its additives to reach the outer web 20 prior to use. The inner web 18 also allows the moisture content and other constituents of the filling material 22 to be maintained in its original (fresh) condition until use.

With reference to FIG. 4, the web 12 may comprise an outer web 20, an inner web 18, and a coating 16 applied to an outer surface 24 of the outer web 20 to form a coated web. In a further embodiment, the coating can release flavorants or other ingredients to the user's mouth when in contact with saliva.

Figure 5:
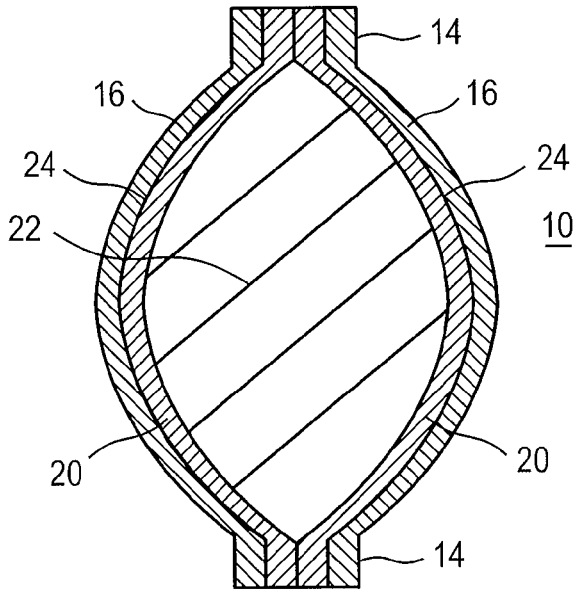
FIG. 5 is a longitudinal cross-sectional view of a fourth embodiment of an oral tobacco pouch product providing controlled flavor release.

With reference to FIG. 5, the web 12 may comprise an outer web 20 and a coating 16 applied to an outer surface 24 of the outer web 20. A filling material 22 is contained within the outer web 20. Preferably, the filling material 22 includes tobacco material and at least one hydrocolloid.

Preferably, the coating 16 includes at least one flavorant and/or other additives, such that the coating 16 rapidly releases at least one flavorant and/or other additives, such as sweeteners, when inserted into an oral cavity. Additionally, the coating 16, the outer web 20 and/or the inner web 18 can include humectants that soften the web 12 during use, such that the web 12 is comfortable in the mouth of a user.

In one embodiment, the at least one flavorant is spearmint oil added as a coating 16 to the outer wrapper 20 to speed up flavor delivery upon placement of the oral tobacco pouch product 10 in a user's mouth. Not wishing to be bound by theory, it is believed that the use of some flavorants in a coating 16, and liquid flavorants in particular (which have an affinity for the web), is preferred because some flavorants do not sufficiently migrate from the filling material to the wrapper and/or user. Thus, some flavorants, such as peppermint oil, may migrate over time from the filling material such that the flavorant is only added as a coating 16 if desired, while other flavorants that are less prone to migrate are preferably added as a coating to the wrapper. In addition, in a preferred embodiment, dry flavorants and/or sweeteners in either liquid or dry form are also applied to the web 12 as a coating 16 because such flavorants and/or sweeteners are not believed to migrate over time.

In one embodiment, the coating 16 comprises at least one polymer, a negligible amount of water and at least one flavorant. In another embodiments, the coating 16 comprises at least one flavorant and at least one sweetener. In an embodiment, the coating 16 can also include additives, such as sweeteners and/or humectants. In other embodiments, the additives described below can also be included in the coating 16. The flavor can be a flavor concentrate mixed with other ingredients such as sucrose, propylene glycol, sucralose, starch, glycerin, sodium alginate, gum arabic, gum acacia, beta cyclodextriate, microcrystalline cellulose, monodiglyceride and water.

In one embodiment, the coating 16 is water-soluble, such that the coating 16 rapidly dissolves and releases one or more flavors when placed in a user's mouth. In another embodiment, the coating 16 is water insoluble. In an embodiment, the coating 16 may include a cross-linked polymer. The amount of cross-linking can be varied to alter the rate of dissolution of the coating 16. Preferably, the viscosity of the coating 16 prior to application is about 600 cps to about 6,000 cps, but may be higher of lower depending on the coating formulation and/or method of application to the inner paper layer.

The coating 16 can include synthetic and/or natural polymers. Exemplary polymers include, without limitation, hydrocolloids, polysaccharides, food proteins, and the like. The polymers can be cross-linkable or non-cross-linkable or combinations thereof.

Suitable non-chemically-cross-linkable polymers include, without limitation, starch and starch derivatives, such as modified starch, dextrin, gums, such as gum arabic, guar gum, xanthan gum, locust bean gum, curdlan gum, gellan gum, fenugreek derivative gums, pullulan, chitosan, chitin, cellulose and cellulose derivatives, synthetic polymers, such as polyvinyl alcohol, polylactide, polyethylene glycol, polyvinylpyrrolidone, or polyvinylacetate, proteins, such as gelatin, zein, soy protein, rice protein, and whey protein, and soluble or insoluble vegetable fiber.

Suitable chemically cross-linkable polymers include, without limitation, alginate, pectin, carrageenan, and modified polysaccharides with cross-linkable functional groups.

When a cross-linking agent is used, the cross-linking agent is a polyvalent metal salt, more particularly, a monovalent metal ion salt or bivalent metal ion salt. While, both monovalent and bivalent metal ion salts may be used, a bivalent metal ion salt is particularly suitable for crosslinking certain polysaccharides, such as pectins. Suitable cross-linking agents include, without limitation, calcium lactate, calcium chloride, calcium lactobionate, tricalcium phosphate, calcium glycerophosphate, calcium hexametaphosphate, calcium acetate, calcium carbonate, calcium bicarbonate, calcium citrate, calcium gluconate, sodium chloride, sodium lactate, sodium acetate, sodium carbonate, sodium bicarbonate, sodium citrate, sodium gluconate, potassium chloride, potassium lactate, potassium acetate, potassium carbonate, potassium bicarbonate, potassium citrate, potassium gluconate and combinations of these.

The coating 16 can include encapsulated flavorants in the form of beads and/or microcapsules embedded therein. The beads and/or microcapsules can contain controlled release flavorants and/or other additives, such as sweeteners, humectants and the like.

The coating 16 preferably dissolves in about 0.1 second to about 30 seconds. These ranges for coating dissolution may be even further restricted to (a) about 1 second to about 25 seconds, (b) about 2 seconds to about 20 seconds, (c) about 3 seconds to about 15 seconds or (d) about 4 seconds to about 10 seconds after introduction into the oral cavity.

Preferably, the coating 16 is applied to a first side 24 of the outer web 20 as a solution, suspension and/or emulsion. For example, the desired ingredients of the coating 16 can be mixed to form a solution, which is then transferred to the first side 24 of the outer web 20 which preferably has a heat sealable adhesive layer on the opposite side. In an embodiment, the outer web 20 includes an adhesive layer on a surface facing the inner web 18. Suitable methods for applying the coating 16 to the first side 24 of the outer web 20 include spray, slot die and/or gravure application methods.

In a preferred embodiment, the coating 16 is added in an amount of about 1 $g/m^2$ to about 50 $g/m^2$ on a dry weight basis to the inner web and the coating, when dried, can have a moisture content of about 5% to about 8%.

To form the filling material, the tobacco material, at least one hydrocolloid, optional additives and optional supplemental non-tobacco botanical material are mixed to form a substantially uniform filling material. In a preferred embodiment, the filling material is mixed using a paddle mixer for about 1 minute to about 20 minutes. The at least one hydrocolloid can be added before and/or after pasteurization of the tobacco material if the tobacco material is pasteurized.

The embodiments that are described with reference to FIGS. 2-5 may further include a dissolvable strip which abates staining of the pouch web by the tobacco and/or releases a flavor upon dissolution during use. Examples of such dissolvable films are described in commonly assigned U.S. Patent Application Publication No. 2007-0012328-A1, filed on Apr. 28, 2006 (U.S. Utility patent application Ser. No. 11/412,842), the entire content of which is incorporated herein by reference.

The examples provided below are exemplary and are not meant to limit any aspects of the embodiments disclosed herein.

EXAMPLE 1

Four parts carrageenan (Gelcarin GP 911, acquired from FMC Biopolymer) and 100 parts of pasteurized ground filler are mixed using a paddle mixer. After mixing for 10 minutes, 9 parts of flavor solution and 1 part of acidity regulator are added to the mixture. The mixture is continuously mixed for 20 minutes to form a substantially uniform mixture. The formed mixture is subsequently used to produce oral tobacco pouch products using a pouching machine. The pasteurized ground filler consists of ground tobacco, fiber and salt. The particle size of the pasteurized filler ranges from about 200 mesh to about 10 mesh and the moisture content of the pasteurized filler is about 14%. Aqueous carbonate solution was used as the acidity regulator.

EXAMPLE 2

Two parts of pectin (Grindsted, XSS100, acquired from Danisco) is mixed with 100 parts of ground filler comprising ground tobacco, fibers and salt. The particle size of the pasteurized filler ranges from about 200 mesh to about 20 mesh and the moisture content in the pasteurized filler is about 16%. The mixture is pasteurized at about 100° C. for about 4 hours. The pasteurized mixture is then mixed with 7 parts of flavor solution and 1 part of acidity regulator using a paddle mixer for about 10 minutes to about 20 minutes to form a substantially uniform flavored filling material. The filling material is then used to produce oral tobacco pouch product using a pouching machine. Aqueous carbonate solution was used as the acidity regulator.

EXAMPLE 3

Six parts of pectin (LM 20 AS, acquired from Univar) and 100 parts of pasteurized ground filler are mixed in a paddle mixer. After mixing for about 10 minutes, 8 parts of flavor solution and 1 part of acidity regulator are added to the mixture. The mixture is continuously mixed for about 20 minutes to form a substantially uniform flavored filler. The substantially uniform flavored filler is then used to produce oral tobacco pouch products using a pouching machine. The pasteurized ground filler comprises ground tobacco, fibers and salt. The particle size of the pasteurized filler ranges from about 200 mesh to about 20 mesh and the moisture content in the pasteurized filler was about 14%. Aqueous carbonate solution was used as the acidity regulator.

EXAMPLE 4

Two parts carrageenan (Lactarin MV 306, acquired from FMC Biopolymer) and 100 parts of pasteurized ground filler are mixed in a paddle mixer. After mixing for about 10 minutes, 7 parts of flavor solution and 1 part of acidity regulator are added to the mixture. The mixture is continuously mixed for 20 minutes to form a substantially uniform flavored filler that is used to produce oral tobacco pouch products using a pouching machine. The pasteurized ground filler comprises ground tobacco, fibers and salt. The particle size of the pasteurized filler ranges from about 200 mesh to about 20 mesh, and the moisture content in the pasteurized filler was about 18%. Aqueous carbonate solution was used as the acidity regulator.

Figure 6:
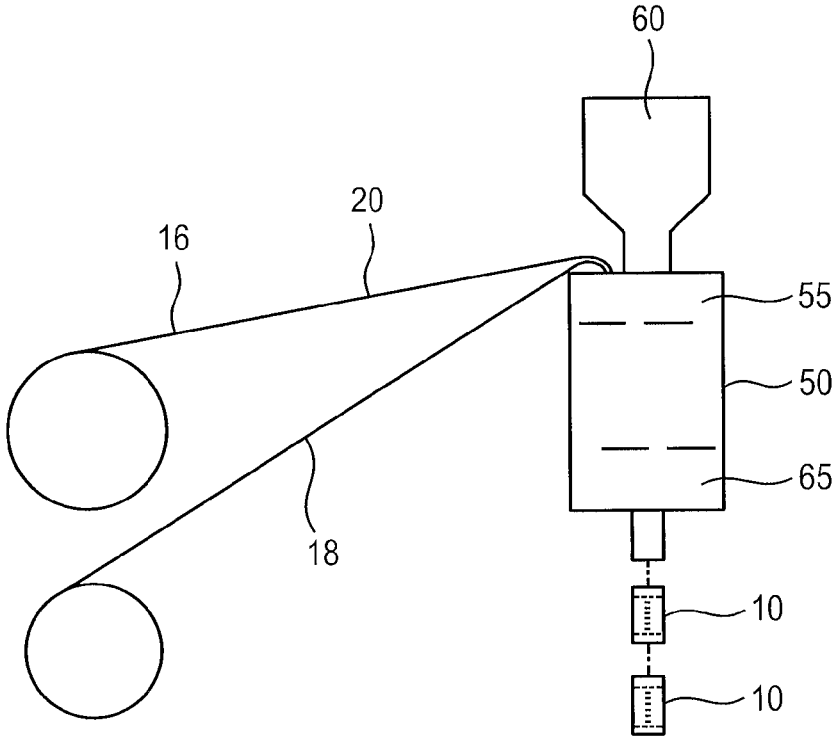
FIG. 6 is a schematic illustration of a machine for forming the pouch product of FIG. 2.

As shown in FIG. 6, pouch forming operations can be executed by feeding a ribbon of outer web 20 through a poucher machine 50, such as those manufactured by Merz Verpackungsmaschinen GmbH, Lich, Germany. In an embodiment, an inner web 18 and an outer web 20 can be fed through the poucher machine 50. Such systems typically include a folding horn or shoe 55, a cutter 65 and a feeder 60, which cooperate to repetitively fold the ribbon of web into a tube, close-off and seal an end portion of the tube, feed a measured amount of pouch filling material into the closed-off tube to create a filled portion of the tube and seal and sever the filled portion of the tube to repetitively form individual pouches 10.

Preferably, the filling material is dispensed as a loose filling material. Most preferably, the filling material is feed into the pouches at a density of about 10 to about 50 pounds per cubic foot or about 15 to about 30 pounds per cubic foot. Superior results in terms of controlled flavor delivery have been observed within these densities. Not wishing to be bound by theory, it is believed that the density of the filling material can affect the way the tobacco juices are released. For example, a higher density may release tobacco juices more slowly than filling materials of a lower density. Thus, a higher density may act to aid the hydrocolloid in slowing release of the tobacco juices during use.

In one embodiment, a coating 16 can be continuously applied to a side of a ribbon of paper comprising the outer web 20. The outer web 20 including the coating 16 can then be continuously fed with the inner web 18 or alone to form pouches during a pouch forming and filling operation.

In another embodiment, the outer web 20 can include a coating on an inner surface thereof. The outer web is then drawn into contact with an inner web, such that the coating is between the outer web and the inner web.

In a preferred embodiment, the wrapper material including the outer web 20 and the inner web 18 can be, for example, about 31 mm and 26 mm wide, respectively. The outer web 20 and the inner web 18 can be fed along a feedpath and folded into a tubular formation. In so doing, the longitudinal edge portions of the web material are brought into an overlapping relation and sealed to form the longitudinal seam 70 (shown in FIG. 1), which is preferably about 3 mm wide in the exemplary embodiment.

Oral tobacco pouch products 10 are continuously formed by introduction of predetermined amounts of the filling material 22 into the tubular form above a transverse seam, formation of an upper transverse seam above the filling and cutting the tubular formation at locations along the length of the tubular formation to form individual pouches.

Sealing may be accomplished by any suitable sealing method, such as, for example, adhesive or by mutual sealing. Mutual sealing may be thermal or sonic. Preferably, sealing is accomplished by thermal sealing. Preferably, the inner web is paper with a flavor coating on one side and is sized to avoid becoming part of the longitudinal seam.

In this specification, the word "about" is often used in connection with numerical values to indicate that mathematical precision of such values is not intended. Accordingly, it is intended that where "about" is used with a numerical value, a tolerance of 10% is contemplated for that numerical value. In addition, the use of geometric terms is intended to include not only the precise geometric shapes, but also similar geometric shapes that may, for example, have rounded or chamfered corners, non-linear edges, and similar departures from strict geometrical definitions.

While the foregoing describes in detail an oral tobacco pouch product with reference to a specific embodiment thereof, it will be apparent to one skilled in the art that various changes and modifications equivalents to the oral tobacco pouch product and process steps may be employed, which do not materially depart from the spirit and scope of the invention. The teachings address how certain consumers have preferences against certain tobacco flavor components (notes) and the use of at least one hydrocolloid to abate such components.

We claim:

1. An oral tobacco pouch product comprising:

a web defining an enclosure; and a loose filling material in said enclosure, said filling material comprising:

tobacco material capable of releasing tobacco flavor; and particles consisting essentially of a hydrocolloid, said particles interspersed with said tobacco material in an amount sufficient to retard release of flavor from the tobacco material when exposed to saliva during use, wherein the hydrocolloid is selected from the group consisting of high-methylated pectin, low-methylated pectin, amidated pectin, hydroxyl methyl propyl cellulose, methyl cellulose, hydroxyl propyl cellulose, xanthan gum, agar, carrageenan, guar gum, alginate, carboxyl methyl cellulose, microcrystalline cellulose, dextrin, and combinations thereof;

the hydrocolloid is included in the oral tobacco pouch product in an amount of about 1% to about 5% by weight based on the weight of the filling material; and the particles have a size ranging from about 300 mesh to about 10 mesh.

2. The oral tobacco pouch product of claim 1, wherein the web includes an outer web.

3. The oral tobacco pouch product of claim 2, wherein the web further includes an inner web.

4. The oral tobacco pouch product of claim 1, wherein the hydrocolloid is selected from the group consisting of pectin, carrageenan, and combinations therewith.

5. The oral tobacco pouch product of claim 1, wherein the filling material includes pectin in an amount of about 2% to about 3% by weight of the filling material, and peppermint oil.

6. The oral tobacco pouch product of claim 1, wherein the density of the filling material lies in the range of about 10 $lb/ft^3$ to about 50 $lb/ft^3$.

7. The oral tobacco pouch product of claim 1, wherein the density of the filling material lies in the range of about 15 $lb/ft^3$ to about 30 $lb/ft^3$.

8. The oral tobacco pouch product of claim 1, wherein the web further includes at least one coating.

9. The oral tobacco pouch product of claim 8, wherein the coating is a polymeric coating, and wherein the coating is present in an amount of about 1 $g/m^2$ to about 50 $g/m^2$.

10. The oral tobacco pouch product of claim 8, wherein the coating has a moisture content in the range of about 5% to about 8% by weight based on the weight of the coating.

11. The oral tobacco pouch product of claim 8, wherein the coating comprises at least one additive selected from the group consisting of flavorants, sweeteners, acidity regulators, and combinations thereof.

12. The oral tobacco pouch product of claim 1, wherein the filling material further comprises at least one additive selected from the group consisting of flavorants, sweeteners, acidity regulators, and combinations thereof.

13. The oral tobacco pouch product of claim 1, wherein the web comprises unflavored paper.

14. The oral tobacco pouch product of claim 1, wherein the filling material comprises smokeless tobacco and a supplemental amount of non-tobacco botanical material.

15. The oral tobacco pouch product of claim 14, wherein the non-tobacco botanical material is selected from the group consisting of vegetable fibers, tea, herbs, spices, coffee, fruits and combinations thereof.

16. The oral tobacco pouch product of claim 14, wherein the non-tobacco botanical material is included in an amount of about 5% to about 45% by weight based on the weight of the inner filling material.

17. The oral tobacco pouch product of claim 1, wherein the filling material has a moisture content in the range of about 5% to about 50%.

18. The oral tobacco pouch product of claim 17, wherein the filling material has a moisture content in the range of about 12% to about 25%.

19. The oral tobacco pouch product of claim 1, wherein the tobacco material is pasteurized.

20. The oral tobacco pouch product of claim 1, wherein the hydrocolloid is included in the oral tobacco pouch product in an amount of about 2% to about 3% by weight based on the weight of the filling material.

21. A method of making an oral tobacco pouch product comprising:

feeding a web along a feed path;

folding the web into a tubular formation;

forming a longitudinal seam along overlapping edges of the web;

forming a lower transverse seam across the tubular formation;

placing a portion of a loose filling material comprising tobacco material and particles consisting essentially of a hydrocolloid into the tubular formation above the transverse seam; and forming an upper transverse seam across the tubular formation to enclose the filling material, wherein the hydrocolloid is included in an amount sufficient to retard the release of flavor from the tobacco material when exposed to saliva during use;

the hydrocolloid is selected from the group consisting of high-methylated pectin, low-methylated pectin, amidated pectin, hydroxyl methyl propyl cellulose, methyl cellulose, hydroxyl propyl cellulose, xanthan gum, agar, carrageenan, guar gum, alginate, carboxyl methyl cellulose, microcrystalline cellulose, dextrin, and combinations thereof;

the hydrocolloid is included in the oral tobacco pouch product in an amount of about 1% to about 5% by weight based on the weight of the filling material; and the particles have a size ranging from about 300 mesh to about 10 mesh interspersed with the tobacco material.

22. The method of claim 21, further comprising mixing the tobacco material and the hydrocolloid to form a substantially uniform filling material.

23. The method of claim 21, wherein the hydrocolloid is included in the oral tobacco pouch product in an amount of about 2% to about 3% by weight based on the weight of the filling material.

24. A method of making a pouched tobacco product comprising:

combining a tobacco component with particles consisting essentially of a pectin in a pouch, said pectin being included in an amount sufficient to delay release of flavor from the tobacco component during contact of said pouched tobacco product with saliva during use, wherein the particles have a size ranging from about 300 mesh to about 10 mesh interspersed with the tobacco component;

the tobacco component and particles form a loose filling material; and pectin is included in the pouched tobacco product in an amount of about 1% to about 5% by weight based on the weight of the filling material.

25. The method of claim 24, wherein pectin is included in the pouched tobacco product in an amount of about 2% to about 3% by weight based on the weight of the filling material.

26. An oral tobacco pouch product comprising:

a web defining an enclosure; and a loose filling material in said enclosure, said filling material comprising:

tobacco material capable of releasing tobacco flavor components; and particles consisting essentially of a hydrocolloid, the particles being interspersed with said tobacco material in an amount sufficient to retard release of flavor from the tobacco material when exposed to saliva, wherein the hydrocolloid in the oral tobacco pouch products interferes with the extraction of undesirable objectionable flavor compounds from the tobacco by saliva when placed in the mouth by reducing mass transfer from the tobacco to saliva;

the hydrocolloid is selected from the group consisting of high-methylated pectin, low-methylated pectin, amidated pectin, hydroxyl methyl propyl cellulose, methyl cellulose, hydroxyl propyl cellulose, xanthan gum, agar, carrageenan, guar gum, alginate, carboxyl methyl cellulose, microcrystalline cellulose, dextrin, and combinations thereof; and the hydrocolloid is included in the oral tobacco ouch product in an amount of about 1% to about 5% by weight based on the weight of the filling material.

27. The oral tobacco pouch product of claim 26, wherein the particles have a size ranging from about 300 mesh to about 10 mesh.

28. The oral tobacco pouch product of claim 26, wherein the hydrocolloid is included in the oral tobacco pouch product in an amount of about 2% to about 3% by weight based on the weight of the filling material.

* * * * *